US009343033B2

(12) United States Patent
Cho

(10) Patent No.: US 9,343,033 B2
(45) Date of Patent: May 17, 2016

(54) METHOD OF CONTROLLING POLARITY OF DATA VOLTAGE AND LIQUID CRYSTAL DISPLAY USING THE SAME

(71) Applicant: LG DISPLAY CO., LTD., Seoul (KR)

(72) Inventor: Changhun Cho, Gumi-si (KR)

(73) Assignee: LG DISPLAY CO., LTD., Seoul (KR)

( * ) Notice: Subject to any disclaimer, the term of this patent is extended or adjusted under 35 U.S.C. 154(b) by 147 days.

(21) Appl. No.: 14/136,453

(22) Filed: Dec. 20, 2013

(65) Prior Publication Data

US 2014/0184580 A1 Jul. 3, 2014

(30) Foreign Application Priority Data

Dec. 28, 2012 (KR) ..... 10-2012-0157536

(51) Int. Cl.
*G09G 3/36* (2006.01)

(52) U.S. Cl.
CPC ..... *G09G 3/3696* (2013.01); *G09G 3/3614* (2013.01); *G09G 3/3648* (2013.01); *G09G 2320/0204* (2013.01)

(58) Field of Classification Search
CPC . G09G 3/3696; G09G 3/3614; G09G 3/3648; G09G 2320/0204
See application file for complete search history.

(56) References Cited

U.S. PATENT DOCUMENTS

| | | | | |
|---|---|---|---|---|
| 2009/0251451 | A1* | 10/2009 | Cha et al. | 345/211 |
| 2011/0037760 | A1* | 2/2011 | Kim et al. | 345/214 |
| 2011/0141153 | A1* | 6/2011 | Lee et al. | 345/690 |
| 2011/0292099 | A1* | 12/2011 | Kim et al. | 345/691 |

* cited by examiner

*Primary Examiner* — Dwayne Bost
*Assistant Examiner* — Stefan M Oehrlein
(74) *Attorney, Agent, or Firm* — Birch, Stewart, Kolasch & Birch, LLP

(57) ABSTRACT

A method of controlling polarity of a data voltage and a liquid crystal display using the same, the method including calculating a direct current DC value of the data from each group which data to be output through I-channels adjacent to each other in a source drive IC belong; accumulating the DC value; comparing an absolute value of the accumulation DC value of the n-th group obtained by adding the accumulation DC value of the n−1-th group accumulated up to the n−1-th group to the DC value of the n-th group (n is positive integer) with a predetermined threshold value; and changing a group polarity data when the absolute value of the accumulation DC value of the n-th group exceeds the threshold value.

10 Claims, 10 Drawing Sheets

FIG. 5A

| n(Number of group) | | 1 | 2 | 3 |
|---|---|---|---|---|
| Conventional | | R G B R G B R G B R G B<br>+ + − − + + − − + + − − | R G B R G B R G B R G B<br>+ + − − + + − − + + − − | R G B R G B R G B R G B<br>+ + − − + + − − + + − − |
| N(n) | | | R G B R G B R G B R G B<br>+ + − − + + − − + + − − | R G B R G B R G B R G B<br>− − + + − − + + − − + + |
| GPOL | | 0 | 0 | 1 |
| G(n) | GPOL=0 | | R G B R G B R G B R G B<br>+ + − − + + − − + + − − | R G B R G B R G B R G B<br>+ + − − + + − − + + − − |
| | GPOL=1 | | R G B R G B R G B R G B<br>− − + + − − + + − − + + | R G B R G B R G B R G B<br>− − + + − − + + − − + + |
| DC(n) | | DC(1) | DC(2) | DC(3) |

FIG. 5B

| n(Number of group) | | 4 | 5 | | n |
|---|---|---|---|---|---|
| Conventional | | R G B R G B R G B R G B<br>+ + − − + + − − + + − − | R G B R G B R G B R G B<br>+ + − − + + − − + + − − | ··· | R G B R G B R G B R G B<br>+ + − − + + − − + + − − |
| N(n) | | R G B R G B R G B R G B<br>− − + + − − + + − − + + | R G B R G B R G B R G B<br>+ + − − + + − − + + − − | ··· | R G B R G B R G B R G B<br>+ + − − + + − − + + − − |
| GPOL | | 1 | 0 | | 0 |
| G(n) | GPOL=0 | R G B R G B R G B R G B<br>+ + − − + + − − + + − − | R G B R G B R G B R G B<br>+ + − − + + − − + + − − | ··· | R G B R G B R G B R G B<br>+ + − − + + − − + + − − |
| | GPOL=1 | R G B R G B R G B R G B<br>− − + + − − + + − − + + | R G B R G B R G B R G B<br>− − + + − − + + − − + + | ··· | R G B R G B R G B R G B<br>− − + + − − + + − − + + |
| DC(n) | | DC(4) | DC(5) | ··· | DC(n) |

METHOD OF CONTROLLING POLARITY OF DATA VOLTAGE AND LIQUID CRYSTAL DISPLAY USING THE SAME

This application claims the benefit of Korean Patent Application No. 10-2012-0157536 filed on Dec. 28, 2012, the entire contents of which is incorporated herein by reference for all purposes as if fully set forth herein.

BACKGROUND

1. Field

The present invention relates to a method of controlling a polarity of data voltage and a liquid crystal display using the same.

2. Related Art

A liquid crystal display of an active matrix driving type displays a moving picture using a thin film transistor (hereinafter, referred to as "TFT") as a switching element. The liquid crystal display may be manufactured in a small size unlike a cathode ray tube (CRT), such that the liquid crystal display is applied to a television as well as a display for a portable information device, office equipment, a computer, or the like to quickly replace the CRT.

Liquid crystal cells of the liquid crystal display may display an image by changing transmissivity in accordance with a potential difference between a data voltage supplied to a pixel electrode and a common voltage supplied to a common electrode. In order to reduce an afterimage, and to prevent deterioration of the liquid crystal, the liquid crystal display is driven in inversion driving method that periodically reverses the polarity of the data voltage applied to the liquid crystal.

Generally, the liquid crystal display controls the polarity of the data to be written to the pixels of a 1 line in response to a polarity control signal POL of which polarities are inverted by 1 horizontal period unit. In the liquid crystal display, the image quality of the liquid crystal display may be deteriorated according to a correlation between the data pattern of the input image with the polarity of the data voltage. As an example, positive and negative data displayed in the pixels of the 1 line are unbalanced, either polarity becomes stronger. When the polarity of the data to be written to the pixels of the 1 line is biased to any one of the polarity, the common voltage Vcom may be shifted. Non-uniformity of the polarity may be determined based on an accumulated direct current (DC) value by counting the polarity of the high gray level data from the 1 line data. Since the reference potential of the liquid crystal cells is changed when the common voltage Vcom is shifted, a user may feel a phenomenon such as a smear, a greenish or a flicker from the image displayed on the liquid crystal display. In the case in which touch sensors are embedded in the liquid crystal display panel in an in-cell type, if the common voltage Vcom is shifted, the recognition rate of the touch sensor may be deteriorated by varying an offset value of the touch sensor signal.

SUMMARY

A method of controlling polarity of a data voltage according to the present invention comprises: calculating a direct current DC value of the data from each group which data to be output through I-channels (I is any one of a multiple of 3 between from 3 to 18) adjacent to each other in a source drive IC belong; accumulating the DC value; comparing an absolute value of the accumulation DC value of the n-th group obtained by adding the accumulation DC value of the n−1-th group accumulated up to the n−1-th group to the DC value of the n-th group (n is positive integer) with a predetermined threshold value; and changing a group polarity data when the absolute value of the accumulation DC value of the n-th group exceeds the threshold value.

The DC value is a value obtained by adding the high gray level data within the group which the data to be output through the I-channels belong.

The group polarity data defines a first polarity representing the group.

A liquid crystal display according to the present invention comprises: a display panel in which data lines and gate lines are orthogonal to each other and pixels are arranged in a matrix form; a source drive IC receiving a group polarity data defining polarity of the data together with a data of an input image to select polarity of each data voltage according to the group polarity data and outputting the data voltages to the data lines; and a timing controller calculating a direct current (DC) value of the data from each group which data to be output through I-channels (I is any one of a multiple of 3 between 3 to 18) adjacent to each other in the source drive IC belong, accumulating the DC value, comparing an absolute value of the accumulation DC value of the n-th group obtained by adding the accumulation DC value of the n−1-th group accumulated up to the n−1-th group to the DC value of the n-th group (n is positive integer) with a predetermined threshold value, and determining the group polarity data based on the comparison result.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings:

FIG. 5A and FIG. 5B are views showing a method of controlling polarity of a data voltage according to an exemplary embodiment of the present invention;

DETAILED DESCRIPTION OF THE EMBODIMENTS

Figure 1:
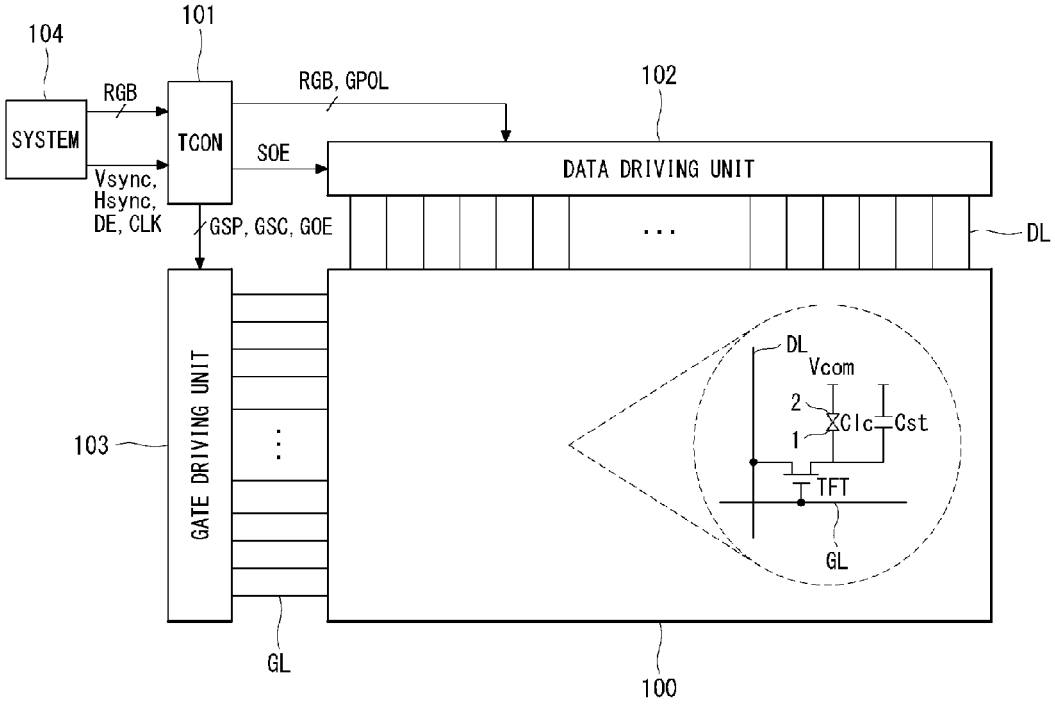
FIG. 1 is a block view showing a liquid crystal display according to an exemplary embodiment of the present invention.

Hereinafter, the preferred embodiments of the present invention will be described in detail with reference to the accompanying drawings. Like reference numerals denote like elements throughout the specification. Hereinafter, when it is determined that the detailed description of the known art related to the present invention may obscure the gist of the present invention, the detailed description thereof will be omitted.

Referring to FIG. 1 to FIG. 4, a liquid crystal display according to the exemplary embodiment of the present invention includes a display panel 100, a timing controller TCON 101, a data driving unit 102 and a gate driving unit 103. The data driving unit 102 includes at least one source drive integrated circuit IC. The gate driving unit 103 includes at least one gate drive IC.

Figure 2:
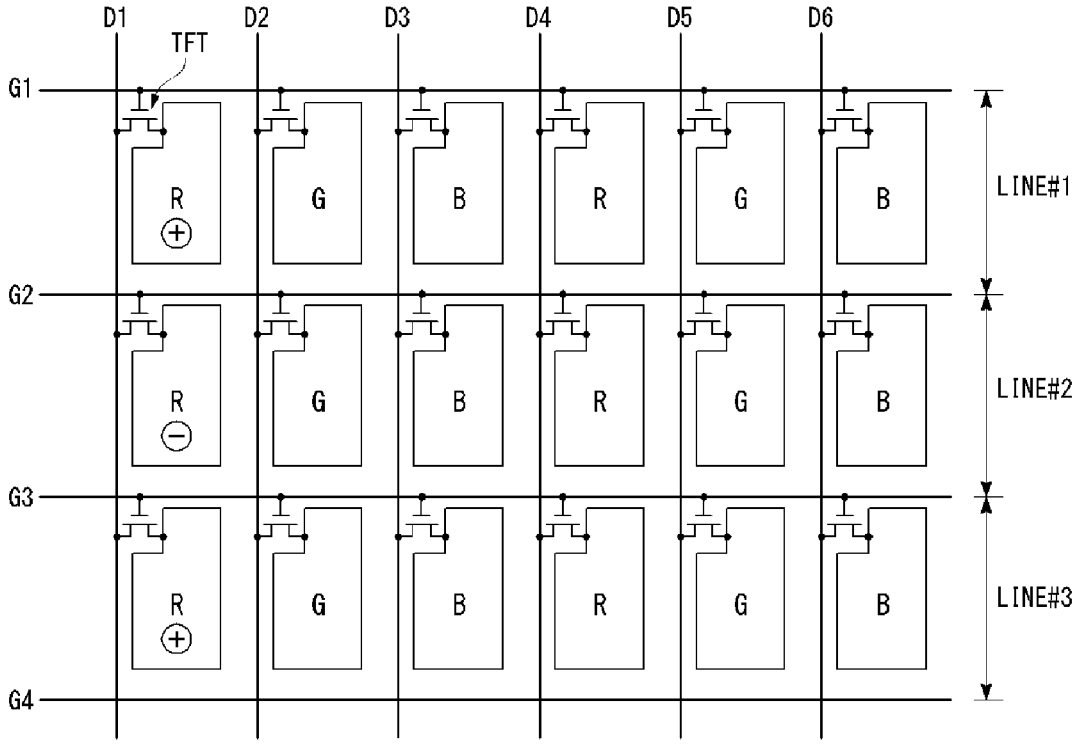
FIGS. 2 to 4 are views showing various structures of a display panel.
Figure 3:
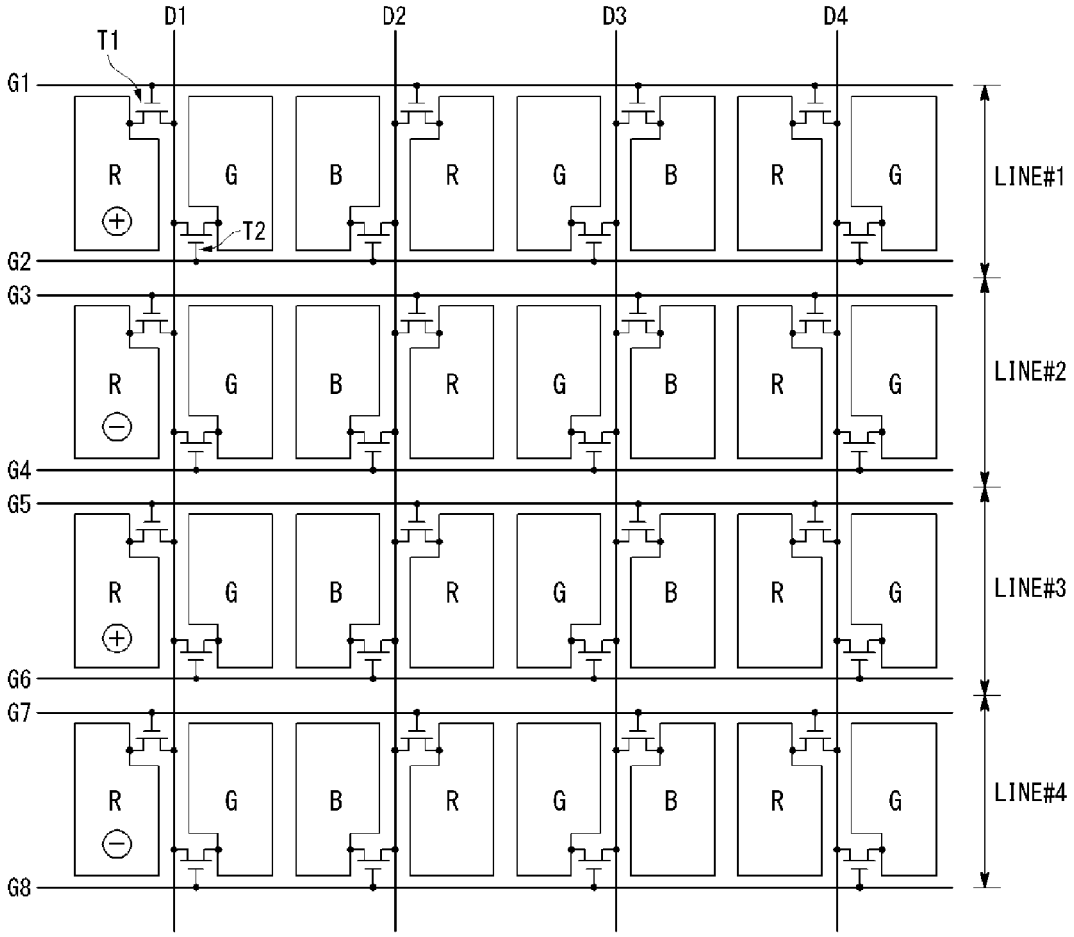
Figure 4:
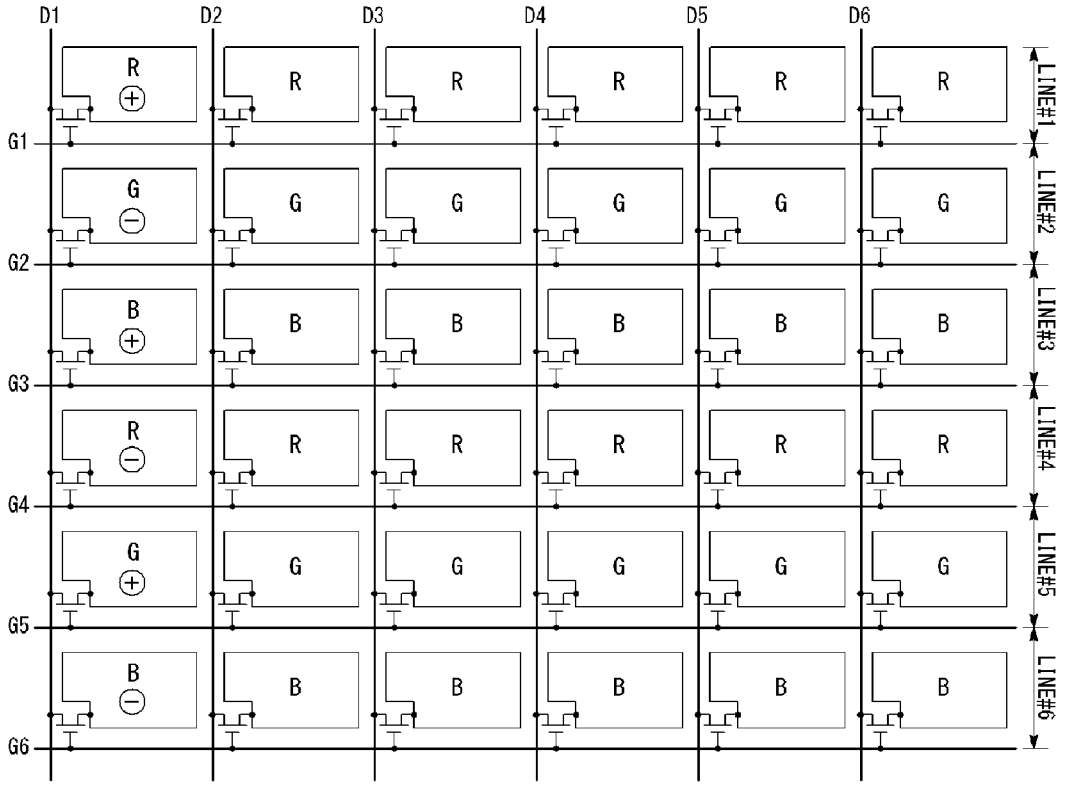

The display panel 100 includes a liquid crystal layer formed between two glass substrates. The display panel 100 includes pixels arranged in a matrix form by a structure in which data lines DL and gate lines GL are intersected with each other. As shown in FIG. 2 to FIG. 4, the pixels may be divided into a red sub-pixel R, a green sub-pixel G and a blue sub-pixel B. Each of the sub-pixels includes liquid crystal cells Clc, a thin film transistor TFT and a storage capacitor Cst.

A pixel array in which an input image is displayed in the display panel 100 is divided into a TFT array and a color filter array. As shown in FIG. 2 to FIG. 4, the TFT array is formed on a lower glass substrate of the display panel 100. The TFT array includes the data lines DL, the gate lines GL intersecting with the data lines DL, the TFTs connected to a pixel electrode 1, the storage capacitor Cst, and the like. The liquid crystal cells Clc are connected to the TFT, and are driven by an electric field between the pixel electrodes 1 and a common electrode 2. A color filter array including a black matrix, a color filter and the like is formed on an upper glass substrate of the display panel 100. A polarizer is attached to each of the upper glass substrate and lower glass substrate and an alignment layer for setting a pre-tilt angle of the liquid crystal is formed thereon. Touch sensors may be embedded in the display panel 100.

The common electrode 2 is formed on the upper glass substrate in a vertical electric field driving mode such as a twisted nematic (TN) mode or a vertical alignment (VA) mode and formed on the lower glass substrate together with the pixel electrode in a horizontal electric field driving mode such as an in plane switching (IPS) mode or a fringe field switching (FFS) mode.

The display panel 100 usable in the present invention may also be implemented in any liquid crystal mode as well as the TN mode, the VA mode, the IPS mode, and the FFS mode described above. The liquid crystal display according to the exemplary embodiment of the present invention may be implemented in many different forms such as a transmission type liquid crystal display, a transflective type liquid crystal display, a reflective type liquid crystal display, and the like. The transmission type liquid crystal display and the transflective type liquid crystal display require a backlight unit. The backlight unit may be implemented by a direct type backlight unit or an edge type backlight unit.

The timing controller 101 transmits the digital video data RGB of the input image is input from a host system SYSTEM 104 to the data driving unit 102.

The timing controller 101 receives a timing signal such as a vertical synchronization signal Vsync, a horizontal synchronization signal Hsync, a data enable signal DE, a clock CLK, and the like from the host system 104. The timing controller 101 generates a timing control signals for controlling an operation timing of the data driving unit 102 and the gate driving unit 103 based on the timing signal that is input from the host system 104. The timing control signals include a gate timing control signal for controlling the operation timing of the gate driving unit 103 and a data timing control signal for controlling the operation timing of the data driving unit 102 and a vertical polarity of the data voltage.

The gate timing control signal includes a gate start pulse GSP, a gate shift clock GSC, a gate output enable GOE, and the like. The gate start pulse GSP is applied to the gate drive IC to control the gate drive IC to generate the first gate pulse. The gate shift clock GSC is a clock signal commonly inputted to the gate drive ICs, which shifts the gate start pulse GSP. The gate output enable signal GOE controls an output of the gate drive ICs. The timing controller 101 transmits the gate timing control signal to the gate drive ICs through a separate control signal bus transmission line.

The data timing control signal includes a group polarity data GPOL, a horizontal polarity data GHINV, channel selection option data GMODE1 and GMODE2, a source output enable signal SOE, and the like. The group polarity data GPOL defines the first polarity representing the polarity pattern of the data to be output at the same time through the I-channels (I is any one of a multiple of 3 between 3 to 18) adjacent to each other in the source drive IC. The horizontal polarity data GHINV controls a horizontal polarity inversion period of the data to be output at the same time through the I-channels of the source drive IC.

The channel selection option data GMODE1 and GMODE2 are input to the source drive ICs supporting multi-channel, select the channel number of the source drive ICs, and disable the channel that is not selected. The source output enable signal SOE controls the output timing of the source drive ICs.

The timing controller 101 transmits a data stream (see FIG. 9) obtained by adding the timing data such as the group polarity data GPOL, the horizontal polarity data GHINV, the channel selection option data GMODE1 and GMODE2, and the like to the RGB digital video data of the input image that belongs to the 1-st group to the source drive ICs through the data bus transmission lines. Therefore, in the source drive ICs, there is no pin that the group polarity data GPOL, the horizontal polarity data GHINV, the channel selection option data GMODE1 and GMODE2 are received. The timing controller 101 transmits the source output enable signal SOE to the source drive ICs through the separate control signal bus transmission line.

Hereinafter, although the exemplary embodiment will describe a case in which the I is 6 for convenience, the I may be 3, 9, 12, 15 and 18, and is not limited thereto. The channels of the source drive ICs mean the output terminals of the source drive ICs, which is 1:1 connected to the data lines.

The timing controller 101 calculates the DC values into a group of a predetermined length before transmitting the data to the source drive ICs. The group is a data group including the data to be output at the same time through the I-channels adjacent to each other in the source drive ICs. The DC value, which is a value obtained by adding the high gray level data among the data within the 1-st group, represents the strength of non-uniform polarity of the group.

The timing controller 101 compares an absolute value of the accumulation DC value of the n-th group obtained by adding the accumulation DC value of the n−1-th group accumulated up to the n−1-th group to the DC value of the n-th group (n is positive integer) with a predetermined threshold value. In addition, the timing controller 101 changes the group polarity data GPOL when the absolute value of the accumulation DC value of the n-th group exceeds the threshold value.

The host system 104 may be implemented by at least one of a television system, a home theater system, a set top box, a navigation system, a DVD player, a blue ray player, a personal computer (PC) and a phone system. The host system 104 scales the digital video data RGB of the input image so as to meet the resolution of the liquid crystal display panel 100. The host system 104 transmits t the timing signals Vsync, Hsync, DE, and MCLK together with the digital video data RGB of the input image to the timing controller 101.

The data driving unit 102 includes at least one of source drive ICs. Each of the source drive ICs includes a shift register, a latch, a digital-analog converter, an output buffer, and the like. The source drive ICs latches by sampling the digital video data RGB under controlling of the timing controller 101. The source drive ICs convert the digital video data RGB into the analog positive/negative gamma compensation voltage to generate the data voltage and invert a polarity of the data voltage in response to a group polarity pattern signal. The source drive ICs output the data voltage in response to the source output enable signal SOE to the data lines DL. The source drive ICs detects the group polarity data GPOL, the horizontal polarity data GHINV and the channel selection option data GMODE1 and GMODE2 from a data packet received together with the digital video data RGB. The source drive ICs decode the group polarity data GPOL to generate the group polarity pattern signal.

The gate drive ICs of the gate driving unit 103 include the shift register and a level shifter. The gate driving unit 103 sequentially supplies the gate pulse to be synchronized with the data voltage in response to the gate timing control signal to the gate lines GL.

FIGS. 2 to 4 are equivalent circuits showing various examples of a thin film transistor TFT array. FIGS. 2 to 4 show a portion of the TFT array. In FIGS. 2 to 4, D1 to D6 refer to data lines, G1 to G6 refer to gate lines, and the LINE#1 to LINE#6 refer to line numbers in the display panel 100.

The TFT array shown in FIG. 2 is a TFT array applied in most of the liquid crystal display. In the TFT array, each of the red sub-pixel R, the green sub-pixel G and the blue sub-pixel B is arranged in a column direction. Each TFT supplies the data voltage from the data line D1 to D6 in response to the gate pulse from the gate line G1 to G4 to the pixel electrode of the liquid crystal cell disposed at the left side (or right side) of the data line D1 to D6. In the TFT array shown in FIG. 2, a single pixel includes the red sub-pixel R, the green sub-pixel G and the blue sub-pixel B adjacent to each other in a row direction (or line direction) perpendicular to the column direction. In FIG. 2, when the resolution of the TFT array is M×N (each of M and N is two or more positive integer), M×3 data lines and the N gate lines are required. In the M×3, 3 is the number of sub-pixels included in one pixel.

The TFT array shown in FIG. 3 has a structure in which the number of the data lines required in the same resolution is reduced in half as compared with the TFT array shown in FIG. 2. A driving frequency of the TFT array shown in FIG. 3 is two times higher than the TFT array shown in FIG. 2. Therefore, the liquid crystal display panel having the TFT array shown in FIG. 3 may refer to as a double rate driving (DRD) panel. Hereinafter, the DRD panel refers to the liquid crystal display panel similar to FIG. 3. The DRD panel may reduce the number of the source drive ICs in half as compared to the TFT array shown in FIG. 2. In the TFT array of the DRD panel, each of the red sub-pixel R, the green sub-pixel G and the blue sub-pixel B is arranged in the column direction. In the TFT array of the DRD panel, a single pixel includes the red sub-pixel R, the green sub-pixel G and the blue sub-pixel B adjacent to each other in a line direction perpendicular to the column direction. The liquid crystal cells adjacent to the left and right in the TFT array of the DRD panel share the same data line and continuously charge the data voltage supplied in a time division manner through the data line. The liquid crystal cell and the TFT disposed at the left side of the data line D1 to D4 refer to a first liquid crystal cell and a first TFT T1, respectively, and the liquid crystal cell and the TFT disposed at the right side of the data line D1 to D4 refer to a second liquid crystal cell and a second TFT T2, respectively. Through this, the structure of the TFT array is as follows. The first TFT T1 supplies the data voltage from the data line D1 to D4 in response to the gate pulse from odd numbered gate lines G1, G3, G5 and G7 to the pixel electrode of the first liquid crystal cell. A gate electrode of the first TFT T1 is each connected to the odd numbered gate lines G1, G3, G5, and G7, a drain electrode thereof is each connected to the data lines D1 to D4. A source electrode of the first TFT T1 is connected to the pixel electrode of the first liquid crystal cell. The second TFT T1 supplies the data voltage from the data line D1 to D4 in response to the gate pulse from even numbered gate lines G2, G4, G6 and G8 to the pixel electrode of the second liquid crystal cell. A gate electrode of the second TFT T2 is each connected to the even numbered gate lines G2, G4, G6, and G8, a drain electrode thereof is each connected to the data lines D1 to D4. A source electrode of the second TFT T2 is connected to the pixel electrode of the second liquid crystal cell. When the resolution of the TFT array of the DRD panel is M×N, the M×3/2 data lines and the 2N gate lines are required.

The TFT array shown in FIG. 4 has a structure in which the number of the data lines required in the same resolution is reduced in half as compared with the TFT array shown in FIG. 2. A driving frequency of the TFT array shown in FIG. 3 is three times higher than the TFT array shown in FIG. 2. Therefore, the liquid crystal display panel having the TFT array shown in FIG. 4 may refer to as a triple rate driving (TRD) panel. Hereinafter, the TRD panel refers to the liquid crystal display panel similar to FIG. 4. In the TFT array of the TRD panel, each of the red sub-pixel R, the green sub-pixel G and the blue sub-pixel B is arranged in the line direction. In the TFT array of the TRD panel, a single pixel includes the red sub-pixel R, the green sub-pixel G and the blue sub-pixel B adjacent to each other in the column direction. In the TFT array of the TRD panel, Each TFT supplies the data voltage from the data lines D1 to D6 in response to the gate pulse from the gate lines G1 to G6 to the pixel electrode of the liquid crystal cell disposed at the left side (or right side) of the data lines D1 to D6. When the resolution of the TFT array of the TRD panel is M×N, the M/3 data lines and the 3N gate lines are required.

The display panel structure according to the exemplary embodiment of the present invention is not limited to at least one among the panel structures shown in FIG. 2 to FIG. 4. Hereinafter, although the display panel structure will be described using the DRD panel in FIG. 3, the present invention is not limited thereto.

FIG. 5A and FIG. 5B are views showing a method of controlling polarity of a data voltage according to an exemplary embodiment of the present invention.

Referring to FIG. 5A and FIG. 5B, the DRD panel supplies the data voltage to the two sub-pixels adjacent to the left and right of the data line through one data line. Therefore, when I is 6, the 1-st group in the DRD panel includes 12 data.

In FIG. 5A and FIG. 5B, the group polarity data GPOL defines a representative polarity value that defines the polarity of the 12 data with the 1-st group. For example, the 1-st group polarity data (GPOL=0) defines a positive (+) which is a first polarity in a predetermined first polarity pattern of "++−−++−−++−−". The 2-nd group polarity data (GPOL=1)

defines a negative (−) which is a first polarity in a polarity pattern of "−−++−−++−−++". The source drive ICs inverts the data voltage polarity of the 12 data belonging to the n-th group in a form of "++−−++−−++−−" in response to the 1-st group polarity data (GPOL=0) received together with the 12 data through the data packet of the n-th group. The source drive ICs inverts the data voltage polarity of the 12 data belonging to the n-th group in a form of "−−++−−++−−++" in response to the 2-nd group polarity data (GPOL=1) received together with the 12 data through the data packet of the n-th group.

The timing controller 101 compares an absolute value of the accumulation DC value (ΣDC(n)) of the n-th group obtained by adding the accumulation DC value (ΣDC(n−1)) up to the n−1-th group to the DC value DC(n) of the n-th group with a predetermined threshold value, and changes the group polarity data GPOL when the absolute value of the accumulation DC value of the n-th group exceeds the threshold value (ΣDC(n)). In FIGS. 5A and 5B, N(n) refers to a data polarity pattern of the 1-st group defined by the group polarity data GPOL selected by the timing controller 101. Meanwhile, with the method of controlling polarity according to the related art, the polarity pattern defined by the polarity control signal POL is repeated regardless of the DC value and the accumulation DC value as seen in the polarity pattern of 'conventional' which is shown at the upper end of FIG. 5A and FIG. 5B.

Figure 6:
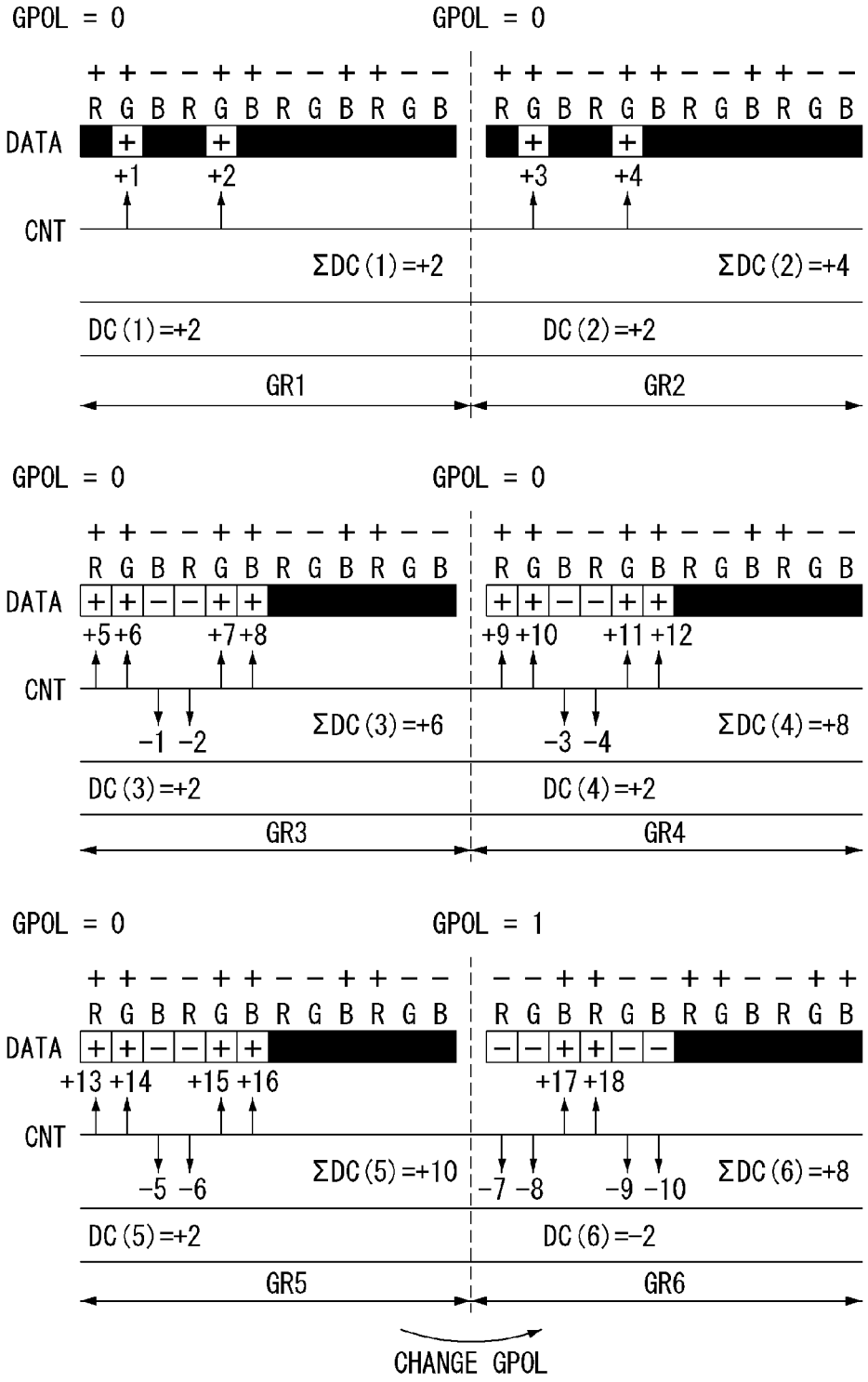
FIG. 6 is view showing an example of a method of controlling polarity of a data voltage according to an exemplary embodiment of the present invention.

FIG. 6 is view showing an example of a method of controlling polarity of a data voltage according to an exemplary embodiment of the present invention.

Referring to FIG. 6, the timing controller 101 maps the data of the input image and the polarity pattern defined by the 1-st group polarity data (GPOL=0) and counts the polarity of the high gray level data. In FIG. 6, CNT refers to a polarity count value. The high gray level may be determined by the most significant bit (MSB). For example, the high gray level data in 6-bit data may be "1XXXXX" data (herein, X is 0 or 1) that the most significant 1 bit is 1.

The timing controller 101 calculates the DC value and the accumulated value for each group based on the accumulated polarity count value of the high gray level data to store the calculated values in the resister. In FIG. 6, since the positive count value for each group is higher by 2 than the negative count value, the DC value of the 1-st to 5-th groups GR1 to GR5 is +2. The accumulation DC value ΣDC(1) of the 1-st group GR1 is ΣDC(1)=0+DC(1)=+2, and the accumulation DC value (ΣDC(2) of the 2-nd group GR2 is ΣDC(2)=ΣDC(1)+DC(2)=+4. The accumulation DC value ΣDC(3) of the 3-rd group GR3 is ΣDC(3)=ΣDC(2)+DC(3)=+6, and the accumulation DC value ΣDC(4) of the 4-th group GR4 represents ΣDC(4)=ΣDC(3)+DC(4)=+8. In addition, the accumulation DC value ΣDC(5) of the 5th group GR5 is ΣDC(5)=ΣDC(4)+DC(5)=+10.

The timing controller 101 determines whether the group polarity data GPOL is changed by comparing the absolute value of the current accumulated DC value with the predetermined threshold value. The threshold value may be changed according to the structure of the display panel and the method of driving the same. When the threshold value is set to 8, since the absolute value of the accumulation DC value ΣDC(4) of the 4-th group GR4 is the threshold value or less, the timing controller 101 maintains the group polarity data GPOL of the 5th group GR5 with GPOL=0. Further, according to the results of comparing the absolute value of the accumulation DC value ΣDC(5) of the 5-th group GR5 with the threshold value, since the absolute value of the accumulation DC value ΣDC(5) of the 5-th group GR5 exceeds the threshold value, the timing controller 101 changes the group polarity data GPOL of the 6-th group GR6 with GPOL=1. As a result, in FIG. 6, the DC value of the 6-th group GR6 is inverted to −2, and the accumulation DC value ΣDC(6) of the 6-th group GR6 drops to ΣDC(6)=ΣDC(5)+DC(6)=+8.

The present invention prevents the change cycle of the group polarity data is too short by maintaining the current group polarity data until the absolute value of the current accumulated DC value exceeds the threshold value. In experiment for verifying effects of the present invention, it is possible to manage the common voltage ripple in the appropriate level and improve the flicker phenomenon of the pixels.

Although, the threshold value may be '8' in FIG. 6, but the present invention is not limited thereto. The threshold value may be set to a value that is divided by N (N is a two or more positive integer) the maximum DC value that may be generated in the data within one group. As the threshold value is small, the flicker phenomenon of the pixel is visible in some image. The threshold value may be selected from values between from 8 to 48. The threshold value is selected appropriately in consideration of the flicker improvement effect of the pixel and the ripple reduction effect of the common voltage. For example, when the data of the input image is 6 bit and the data belonging to one group is 6 data, the maximum DC value is 64+64+64=192. When the N is 8, the threshold value is 192/8=24. In this case, the timing controller 101 may change the group polarity data GPOL when the accumulation DC value is a 24 or more, which is ⅛ of the maximum generation amount of the DC.

Figure 7:
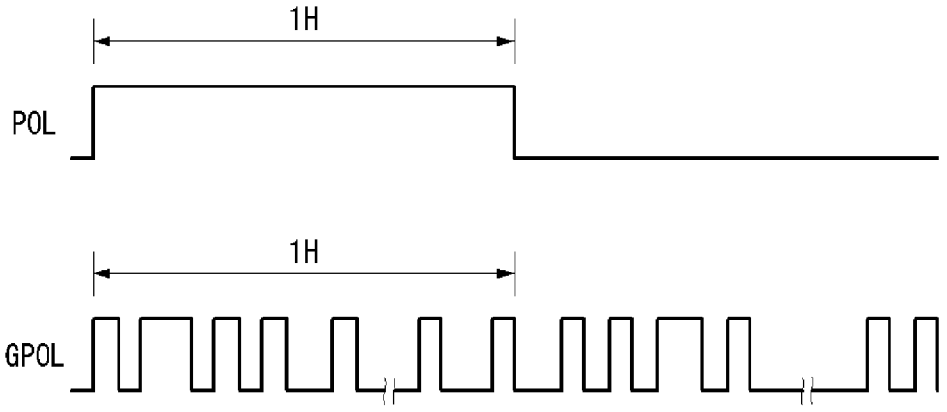
FIG. 7 is a view comparing the polarity control signal according to the related art with a group polarity data according to the present invention.

FIG. 7 is a view comparing the polarity control signal POL according to the related art with a group polarity data GPOL according to the present invention.

Referring to FIG. 7, the polarity control signal POL is inverted in a 1 horizontal period 1H or a 2 horizontal period 2H in a dot inversion. Therefore, the polarity control signal POL according to the related art inverts the polarity of the data voltage in a 1 or 2 line period of the display panel 100. Comparably, the group polarity data GPOL according to the exemplary embodiment of the present invention controls the polarity pattern of one group is much less than the 1 line, such that the group polarity data GPOL is inverted twice or more within the 1 horizontal period. Number of inversions of the group polarity data GPOL within the 1 horizontal period is changed according to the threshold value and the accumulation DC value accumulated up to now.

Figure 8:
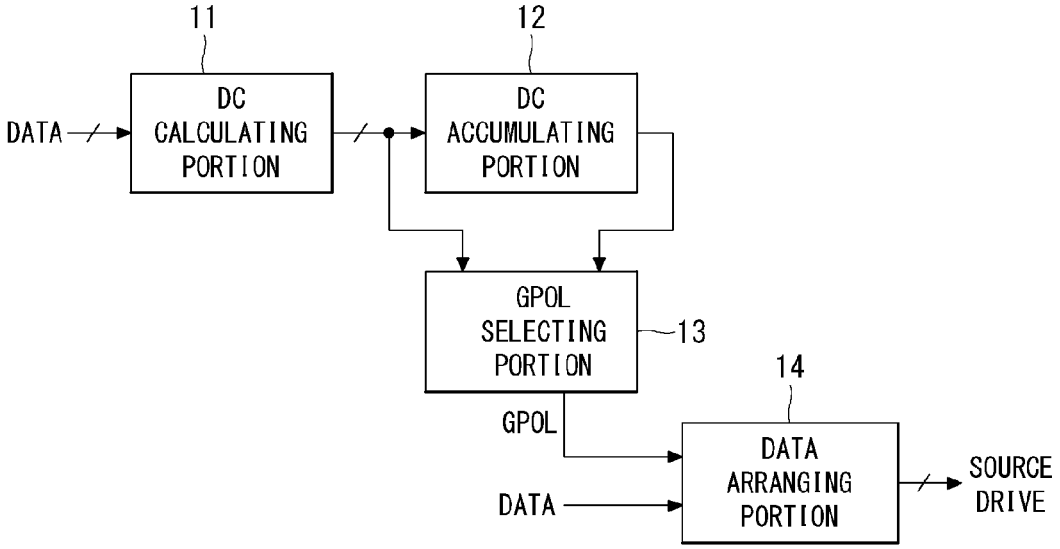
FIG. 8 is a view showing a portion generating group polarity data in a timing controller.

FIG. 8 is a view showing a portion of generating the group polarity data in a timing controller 101 according to the exemplary embodiment of the present invention.

Referring to FIG. 8, the timing controller 101 includes a DC calculating portion 11, a DC accumulating portion 12, a GPOL selecting portion 13 and a data arranging portion 14.

The DC calculating portion 11 calculates the DC value of the input image data in the group unit to supply the calculated DC value to the DC accumulating portion 12 and the GPOL selecting portion 13. The DC accumulating portion 12 calculates the accumulation DC value by adding the DC value for each group that is input from the DC calculating portion 11. The GPOL selecting portion 13 calculates the absolute value of the accumulation DC value of the n-th group obtained by adding the DC value of the n-th group that is input from the DC calculating portion 11 and the accumulation DC value of the n−1-th group that is input from the DC accumulating portion 12 to compare the absolute value with the threshold value. In addition, the GPOL selecting portion 13 changes the group polarity data GPOL when the absolute value of the accumulation DC value of the n-th group exceeds the threshold value. The GPOL selecting portion 13 compares the group polarity data GPOL adjacent to each other may change a line representative polarity of a next line to be described below according to results of the comparison. The line representative polarity defines the polarity of the first sub-pixel for each line.

Figure 9:
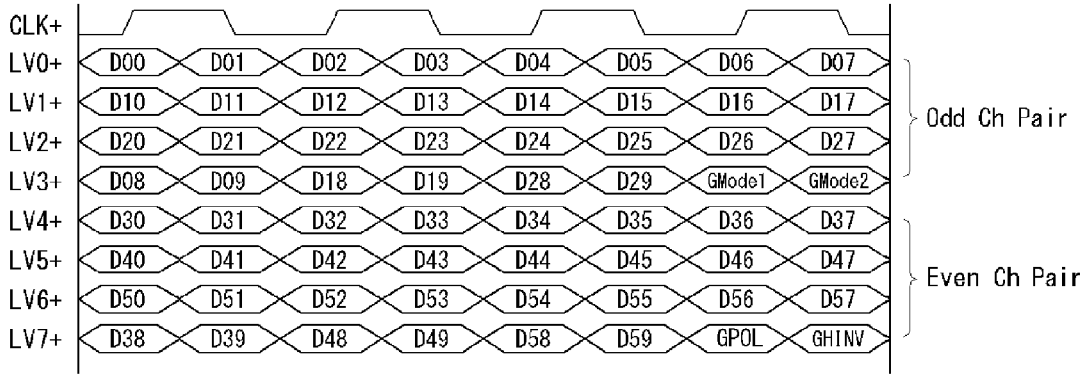
FIG. 9 is a view showing an example of a data stream transmitted by mini LVDS interface standard between a timing controller and a source drive integrated circuit (IC)

The data arranging portion 14 arranges the group polarity data GPOL, the horizontal polarity data GHINV, the channel selection option data GMODE1 and GMODE2 together with the input image data in the data stream form as shown in FIG. 9, and transmits to the source drive ICs of the data driving unit 102.

In FIG. 2 to FIG. 4, the polarity of the first sub-pixel positioning at the leftmost in the each line is the line representative polarity representing the line. The group polarity data GPOL of the 1-st group in the each line is determined according to the line representative polarity. For example, when the line representative polarity is positive polarity, the group polarity data GPOL of the 1-st group in the line is GPOL=0, and when the line representative polarity is the negative polarity, the group polarity data GPOL of the 1-st group in the line is GPOL=1. The group polarity data GPOL may be selected to a value obtained by inverting or maintaining the line representative polarity by comparing the DC value of the groups adjacent to each other with a sign of the DC value.

For example, as shown in FIG. 6, in the case in which the DC value of the 1-st group refers to DC(1), the DC value of the 2-nd group refers to DC(2), the DC value of the 3-rd group refers to DC(3) and the DC value of the 4-th group refers to DC(4), When |DC(1)|=|DC(2)| and the sign of the DC(1) and sign of the DC(2) are the same, the group polarity data GPOL of the 2-nd group is selected to the value obtained by inverting the line representative polarity.

When |DC(1)|=|DC(2)| and the sign of the DC(1) and sign of the DC(2) are different from each other, the group polarity data GPOL of the 2-nd group and the group polarity data GPOL of the 1-st group are selected to the same polarity as the line representative polarity.

When |DC(1)+DC(2)|=|DC(3)+DC(4)| and the sign of the DC(1)+DC(2) and sign of the DC(3)+DC(4) are the same, the group polarity data GPOL of the 3-rd group is selected to the value obtained by inverting the line representative polarity, and the group polarity data GPOL of the 2-nd group is selected to the same polarity as the line representative polarity.

When |DC(1)+DC(2)|=|DC(3)+DC(4)| and the sign of the DC(1)+DC(2) and sign of the DC(3)+DC(4) are different from each other, the group polarity data GPOL of the 3-rd group and the group polarity data GPOL of the 2-nd group are selected to the same polarity as the line representative polarity.

Referring to FIG. 9, in a differential signal pair of mini LVDS interface standard, the timing controller 101 transmits the clock signal (CLK+), the digital video data of the input image, the group polarity data GPOL, the horizontal polarity data GHINV, and the channel selection option data GMODE1 and GMODE2 to the source drive ICs through the data bus transmission line. FIG. 9 shows only the positive polarity data in the differential signal pair. The CLK+ is a clock bus transmission line that the positive clock signal is transmitted, LV1+ to LV7+ are the data bus transmission lines that the positive data stream is transmitted. When the timing controller 101 outputs each of the RGB data of the input image to 10 bit data, and simultaneously outputs the odd numbered pixel data and the even numbered pixel data, each of D00 to D29 is the odd numbered RGB digital video data of the 10 bit, and each of D30 to D59 is the even numbered RGB digital video data of the 10 bit.

Figure 10:
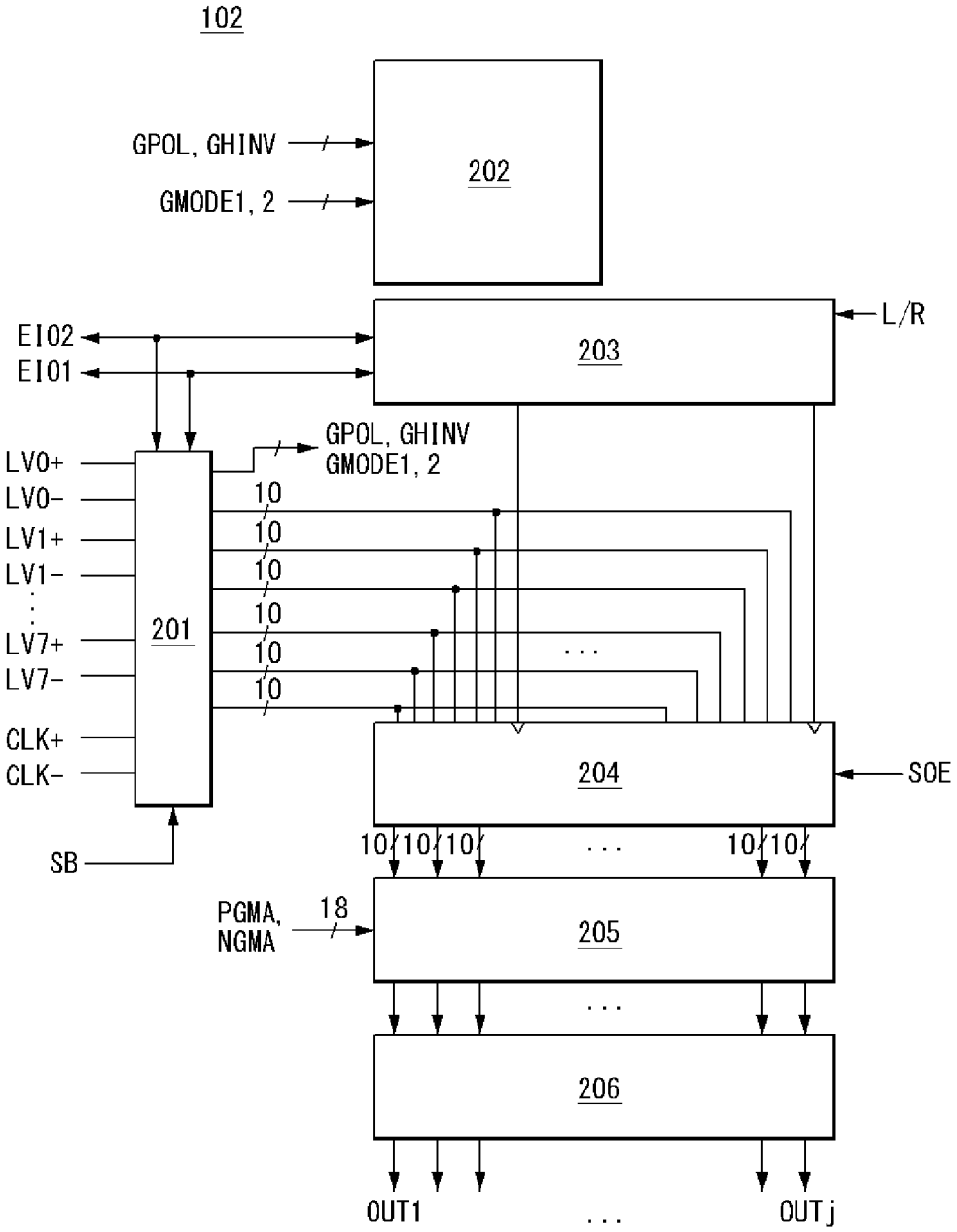
FIG. 10 is a detailed block view showing a source drive IC.

FIG. 10 is a detailed block view showing a source drive IC.

Referring to FIG. 10, each of the source drive ICs supplies the data voltage to the j data lines through the j channels (j is a positive integer less than the number of data lines i×2 or more). The each of the source drive ICs includes a data receiving circuit 201, a control logic circuit 202, a shift register 203, a latch 204, a digital-analog converter (hereinafter, referred to as "DAC") 205 and an output circuit 206.

The data receiving circuit 201 receives the differential signal pair including the clock signal, the digital video data of the input image, the group polarity data GPOL, the horizontal polarity data GHINV, and the channel selection option data GMODE1 and GMODE2 through the data bus transmission lines LVO+ to LV7−, CLK+ and CLK− that the differential signal pair is supplied. The data receiving circuit 201 samples and separates the group polarity data GPOL, the horizontal polarity data GHINV, and the channel selection option data GMODE1 and GMODE2 from the differential signal pair to supply the data to the control logic circuit 202. In addition, the data receiving circuit 201 samples the RGB digital video data in the differential signal pair to transmit the data to the latch 204. SB that is input to the data receiving circuit 201 is a option signal for changing the data arranging order. EIO1 and EIO2 that are input to the data receiving circuit 201 are a start pulse of the shift resister 203. The data receiving circuit 201 is synchronized with the shift register 203 in response to the EIO1 and EIO2.

The control logic circuit 202 selects the polarity of each of the data voltages to be output through the I-channels in response to the group polarity data GPOL. In the control logic circuit 202, two polarity patterns, that is, "++−−++−−++−−" and "−−++−−++−−++" determining the polarity in one group are stored in the preset. In the case of the GPOL=0, the control logic circuit 202 selects the polarity of each of the data voltages to be output through the I-channels to "++−−++−−++−−". On the other hand, In the case of the GPOL=1, the control logic circuit 202 selects the polarity of each of the data voltages to be output through the I-channels to "−−++−−++−−++".

The shift register 203 generates an inner clock signal by shifting the EIO1 and EIO2 to supply the inner clock signal to the latch 204. L/R is an option signal for changing the shift direction of the shift register 203. The latch 204 latches the RGB digital video data from the data receiving circuit 201 in response to the inner clock signal that is sequentially input from the shift register 203 to simultaneously output the latched data in response to the source output enable signal SOE.

The DAC 205 converts the data from the latch 204 into the positive gamma reference voltage PGMA and the negative gamma reference voltage NGMA, and selects any one of the data in response to the polarity control signal to convert the data into the positive data voltage or negative data voltage. The output circuit 206 outputs the positive/negative data voltage from the DAC 205 to the data lines through the output buffer.

As described above, the present invention controls to minimize the common voltage ripple by changing the data polarity pattern in a direction in which the sum of the DC value calculated in the data unit of the predetermined number and the DC value accumulated up to now is minimized. The present invention compares the absolute value of the accumulation DC value of the n-th group obtained by adding the accumulation DC value of the n−1-th group accumulated up to the n−1-th group to the DC value of the n-th group with the predetermined threshold value, and changes the group polarity data when the absolute value of the accumulation DC value of the n-th group exceeds the threshold value according to the comparison result. As a result, the present invention manages the common voltage ripple in the appropriate level, thereby making it possible to solve the flicker phenomenon of the some pixels and the ghost phenomenon generated when the mouse point moves.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A method of controlling polarity of a data voltage, the method comprising:

calculating a direct current (DC) value data to be written to each group of sub-pixels among a plurality of sub-pixel groups, from each group defined based on outputting data at a same time through I-channels adjacent to each other in a source drive integrated circuit (IC), where I is a multiple of 3 between 3 to 18;

setting a group representative value defining polarity of a first sub-pixel positioned leftmost in each corresponding group; and selecting the group polarity data using a value obtained by inverting or maintaining the group representative polarity by comparing the DC value of the groups adjacent to each other with a sign of the DC value;

summing the DC values of each of the 1st through n-th groups to create an accumulation DC value for the n-th group, where n is a positive integer;

comparing an absolute value of the accumulation DC value of the n-th group to a predetermined threshold value;

and changing the group polarity data for the n-th group in response to the absolute value of the accumulation DC value of the n-th group exceeding the threshold value, wherein the DC value of each group is a value obtained by adding high gray level data among the data to be written to the corresponding group, and wherein the group polarity data defines a first polarity representing the group.

2. The method of claim 1, wherein the group polarity data is included in a data stream in which the data belonging within one group are included and is transmitted to the source drive IC.

3. The method of claim 2, wherein the source drive IC selects the polarity of each of the data voltages to be output through the I-channels in response to the group polarity data.

4. The method of claim 1, further comprising:

selecting the group polarity data using the value obtained by inverting or maintaining the group representative polarity by comparing the DC value of the groups adjacent to each other with a sign of the DC value, when the DC value of the 1-st group refers to DC(1), the DC value of the 2-nd group refers to DC(2), the DC value of the 3-rd group refers to DC(3) and the DC value of the 4-th group refers to DC(4), when |DC(1)|=|DC(2)|, and a sign of the DC(1) and a sign of the DC(2) are the same, the group polarity data of the 2-nd group is selected to the value obtained by inverting the group representative polarity, and the group polarity data of the 1-st group is selected to the same polarity as the group representative polarity, when |DC(1)|=|DC(2)| and the sign of the DC(1) and sign of the DC(2) are different from each other, the group polarity data of the 2-nd group and the group polarity data of the 1-st group are selected to the same polarity as the group representative polarity, when |DC(1)+DC(2)|=|DC(3)+DC(4)| and a sign of the DC(1)+DC(2) and a sign of the DC(3)+DC(4) are the same, the group polarity data of the 3-rd group is selected to the value obtained by inverting the group representative polarity, and the group polarity data of the 2-nd group is selected to the same polarity as the group representative polarity, and when |DC(1)+DC(2)|=|DC(3)+DC(4)| and the sign of the DC(1)+DC(2) and sign of the DC(3)+DC(4) are different from each other, the group polarity data of the 3-rd group and the group polarity data of the 2-nd group are selected to the same polarity as the group representative polarity.

5. The method of claim 1, wherein the high gray level data is a value based on a most significant bit of the data to be written to a corresponding group.

6. A liquid crystal display, comprising:

a display panel in which data lines and gate lines are orthogonal to each other and pixels are arranged in a matrix form;

a source drive integrated circuit (IC) configured to: receive a group polarity data defining polarity of data to be written to each group of sub-pixels among a plurality of sub-pixel groups, the data including data of an input image and select polarity of each data voltage according to the group polarity data and outputting the data voltages to the data lines;

and a timing controller configured to:

calculate a direct current (DC) value of the data to be written to each corresponding group, each group defined based on outputting data at a same time through I-channels adjacent to each other in the source driver IC, where I is a multiple of 3 between 3 to 18, set a group representative value defining polarity of a first sub-pixel positioned leftmost in each corresponding group; and select the group polarity data using a value obtained by inverting or maintaining the group representative polarity by comparing the DC value of the groups adjacent to each other with a sign of the DC value;

sum the DC values of each of the through n-th groups to create an accumulation DC value for the n-th group, where n is a positive integer, compare an absolute value of the accumulation DC value of the n-th group to a predetermined threshold value, and change the group polarity data for the n-th group in response to the absolute value of the accumulation DC value of the n-th group exceeding the threshold value, wherein the DC value of each group is a value obtained by adding high gray level data among the data to be written to the corresponding group, and wherein the group polarity data defines a first polarity representing the group.

7. The liquid crystal display of claim 6, wherein the timing controller transmits a data stream obtained by adding the group polarity data to the data belonging within one group to the source drive IC.

8. The liquid crystal display of claim 7, wherein the source drive IC selects the polarity of each of the data voltages to be output through the I-channels in response to the group polarity data.

9. The liquid crystal display of claim 6, wherein the timing controller selects the group polarity data using the value obtained by inverting or maintaining the group representative polarity by comparing the DC value of the groups adjacent to each other with a sign of the DC value, when the DC value of the 1-st group refers to DC(1), the DC value of the 2-nd group refers to DC(2), the DC value of the 3-rd group refers to DC(3) and the DC value of the 4-th group refers to DC(4), when |DC(1)|=|DC(2)|, and a sign of the DC(1) and a sign of the DC(2) are the same, the group polarity data of the 2-nd group is selected to the value obtained by inverting the group representative polarity, and the group polarity data of the 1-st group is selected to the same polarity as the group representative polarity, when |DC(1)|=|DC(2)| and the sign of the DC(1) and sign of the DC(2) are different from each other, the group polarity data of the 2-nd group and the group polarity data of the 1-st group are selected to the same polarity as the group representative polarity, when |DC(1)+DC(2)|=|DC(3)+DC(4)| and a sign of the DC(1)+DC(2) and a sign of the DC(3)+DC(4) are the same, the group polarity data of the 3-rd group is selected to the value obtained by inverting the group representative polarity, and the group polarity data of the 2-nd group is selected to the same polarity as the group representative polarity, and when |DC(1)+DC(2)|=|DC(3)+DC(4)| and the sign of the DC(1)+DC(2) and sign of the DC(3)+DC(4) are different from each other, the group polarity data of the 3-rd group and the group polarity data of the 2-nd group are selected to the same polarity as the group representative polarity.

10. The liquid crystal display of claim 6, wherein the high gray level data is a value based on a most significant bit of the data to be written to a corresponding group.

* * * * *